United States Patent [19]

Hovis

[11] Patent Number: 4,941,237

[45] Date of Patent: Jul. 17, 1990

[54] CLOTHING SECURING DEVICE

[76] Inventor: William K. Hovis, 1295 Dresden Dr., NE., Atlanta, Ga. 30319

[21] Appl. No.: 316,514

[22] Filed: Feb. 28, 1989

[51] Int. Cl.[5] ..... A44B 21/00

[52] U.S. Cl. ..... 24/304; 24/306; 2/319; 2/338

[58] Field of Search ..... 24/304, 306; 2/DIG. 6, 2/307, 308, 309, 314, 319, 333, 337, 338

[56] References Cited

U.S. PATENT DOCUMENTS

| | | | |
|---|---|---|---|
| 2,896,220 | 7/1959 | Kenny | 2/319 |
| 3,405,408 | 10/1968 | Bahee | 24/306 X |
| 3,423,764 | 1/1969 | Cassling | 2/337 |
| 3,679,530 | 7/1972 | Perina | 24/306 X |
| 4,040,124 | 8/1977 | Zoephel | 2/338 X |
| 4,063,313 | 12/1977 | Hagios | 2/338 |

FOREIGN PATENT DOCUMENTS

| | | | |
|---|---|---|---|
| 1315873 | 12/1962 | France | 2/237 |

*Primary Examiner*—Laurie K. Cranmer

*Attorney, Agent, or Firm*—Hurt, Richardson, Garner, Todd & Cadenhead

[57] ABSTRACT

A fastening device for securing a pair of normally overlapping portions or wearing apparel in a fixed relationship comprising a first fastening member having opposed surfaces with adhesive disposed along one surface for adhering said first fastening member to the first portion of wearing apparel, and a clinging element secured to the other surface of said first fastening member; a second fastening member having opposite surfaces with a clinging element secured to one surface of said second fastening member; and a mounting means connecting said second fastening member to the other portion of wearing apparel such that when said portions of wearing apparel are in their overlapping relationship with two fastening members releasably interlock to secure the portions of wearing apparel in a fixed relationship.

3 Claims, 1 Drawing Sheet

CLOTHING SECURING DEVICE

BACKGROUND OF THE INVENTION

1. Field of the invention

This invention relates to an apparatus for holding overlapping portions of clothing together securely and, more particularly, with a clothing securing device.

2. Discussion of the Prior Art

In the past, a method for reducing the amount of sliding of one portion or article of clothing with respect to an overlapping portion or article has been to arrange fabric having an irregular surface on the insides of the overlapping portion or article of clothing, such as pants and other apparel. While such an arrangement might retard the movement of one piece of fabric or article with respect to another piece of fabric or article of a person's clothing, the use of such a device will not releaseably fix one piece of fabric or article of clothing with respect to the next. Additions such as belt loops on pants and skirts position the belt in a prescribed position with respect to the skirt or pants; however, the blouse or shirt must still be tucked into and beneath the waist of the pants or skirt and be held there frictionally.

Another method has been to use VELCRO® on shoes for holding two straps of the shoe in overlapping relationship in place of or in addition to shoe strings so as to tighten the mouth of the shoe to keep the shoe from falling off of the foot.

A third method has been used mainly on children's clothing. With children's clothing, there are sometimes provided a plurality of circumferentially spaced buttons and buttonholes or circumferentially spaced buttons and flaps or tabs containing button holes. The clothing can be folded over and the button can be engaged in the buttonhole in order to fix the relative positions of overlapping portions of the clothing. Generally, the buttons and buttonholes, flaps or tabs are located on the waist portion of the children's clothing.

A further method has been the use of suspenders, which button or clamp to pants or skirt and hold the pants or skirt in the proper position because of resilient straps which pass over the shoulders of the wearer. These suspenders do not provide for positive positioning of a skirt with respect to a blouse or a pair of pants with respect to a shirt, but merely hold the pants or skirt at a predetermined desired height relative to the body.

Frictionally held shirts and blouses have a tendency to slide when a person sits down or leans over so that the shirttail or blouse tail will pull out from beneath a skirt or pair of pants. This would not be a problem if the shirttail or blouse tail would return to its original position; however, it is well known that this does not occur without human interdiction. In the absence of a sufficient number of belt loops, belts also tend to ride up and away from the waist of a skirt or pair of pants when a person, wearing the belt, leans over.

The present invention solves the problem of maintaining overlapped pieces of clothing, such as a belt, in an appropriate position with respect to a skirt or pair of pants, and also solves the problem of retaining a belt, or a blouse or shirt, in an appropriate position with respect to a pair of pants or a skirt or another article of clothing.

SUMMARY OF THE INVENTION

Briefly described, the present invention includes a first fastening member having a loop portion of VELCRO® or similar securing fabric , the rear surface of which is provided with a pressure sensitive adhesive, initially covered by a protective sheet. Cooperating with the loop portion of the VELCRO® is a second fastening member having hook portions. Securing pin assemblies at the end portions of the second fastening member enable the second fastening member to be removeably secured to a portion of clothing. The loop portion of the VELCRO® includes a plurality of small loops of quite thin monofilament yarns or lines which are curled so as to provide outwardly protruding loops in random fashion along the entire surface of a first fastening member. The hook portion of the second fastening member includes a plurality of longitudinally extending rows of upstanding yieldable plastic hooks with alternate first and second longitudinal rows, the first rows being arranged with the hooks facing in the same direction and second rows being arranged so that the hooks open in the opposite direction from the hooks of the first row. When the two faces of the fastening members are urged together, the hooks yieldably engage the loops so as to maintain the two members in interlocking, but releaseable relationship.

When the two members of the fastening device are appropriately respectively positioned on the two elements of apparel and the two elements of apparel are brought into overlapping juxtaposed position, the registering fastening members when urged together will effectively maintain the juxtaposed clothing elements in a continguous relationship. The two elements of apparel, thereafter, can be readily and easily disengaged from each other, by simply pulling on one element with respect to the other separating the VELCRO® members from each other.

Accordingly, it is an object of the present invention to provide a fastening device assembly for wearing apparel which can readily be interchanged from one article of clothing to the next and which will maintain two elements of the wearing apparel in overlapping juxtaposed relationship, while at the same time permitting ready disengagement of one element of the apparel from the other.

Another object of the present invention is to provide a fastening means assembly by which the belt of a person may be maintained in appropriate relationship surrounding and overlapping the waist portion of a skirt or a pair of pants.

Another object of the present invention is to provide a means for removably joining two pieces of fabric together.

Another object of the present invention is to provide a fastening device assembly which is inexpensive to manufacture, durable in structure and efficient in operation.

Other objects, features and advantages of the present invention will become apparent from the following description when taken in conjunction with the accompanying drawing wherein like characters of reference designate corresponding parts throughout the several views.

DETAILED DESCRIPTION OF A PREFERRED EMBODIMENT

Figure 1:
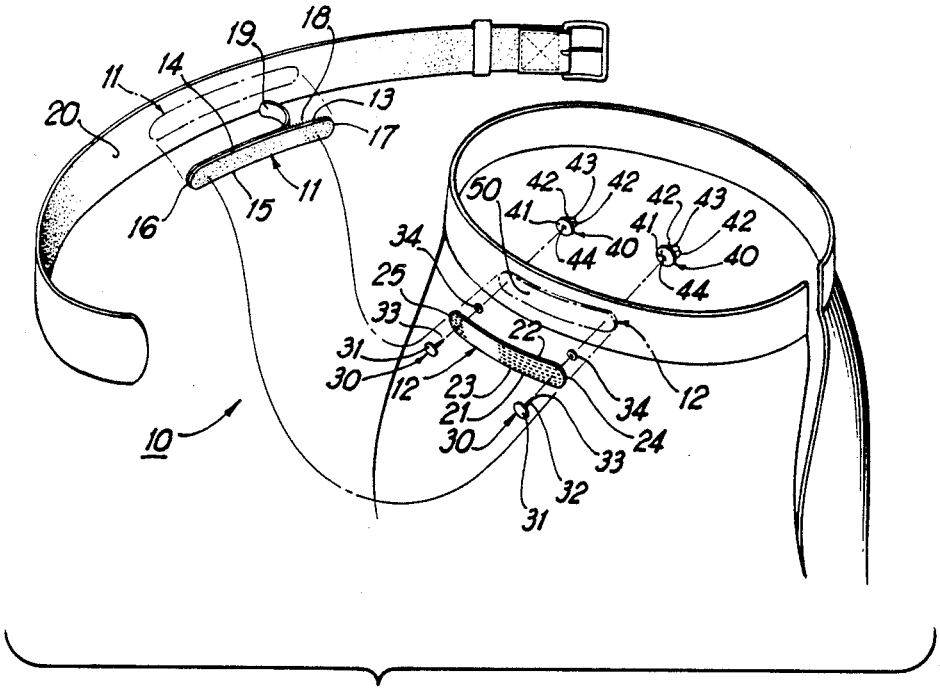
FIG. 1 is an exploded perspective view of the clothing securing device in relation to a respective garment.
Figure 2:
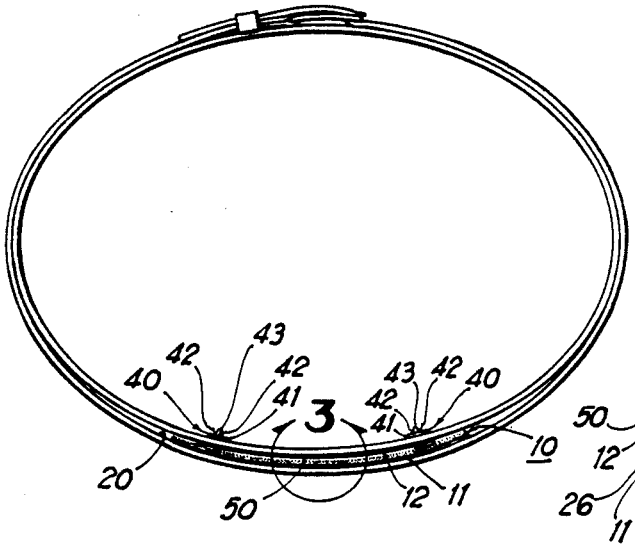
FIG. 2 is a top plan view of the clothing securing device as viewed in use.
Figure 3:
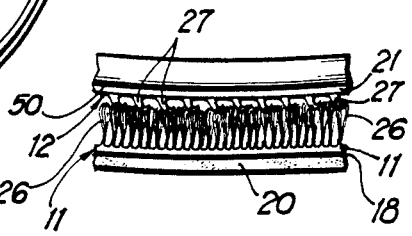
FIG. 3 is an enlargement taken from inset circle-3 in FIG. 2.

Referring now to FIGS. 1-3 which represent in detail the embodiment chosen for the purpose of illustrating the present invention, numeral 10 denotes generally the fastening device of the present invention which includes a pair of cooperating fastening members or elements 11 and 12.

The base fastening element 11 includes a base substrate 13 formed of flexible woven material This substrate 13 is an elongated ribbon having parallel edges 14 and 15 and rounded ends 16 and 17. The back surface of the substrate 13 is provided with a layer of pressure sensitive adhesive material 18 applied uniformly throughout the length of the substrate 13. This pressure sensitive adhesive material 18 is covered with a protective tape or sheet 19 which is adhered by and coextensive with the adhesive material 18. When the protective tape 19 is stripped from the adhesive material 18 the exposed tacky back surface of the substrate 13 may be applied directly to a surface of clothing, such as the inner surface of belt 20, and will cling and be adhered thereto when pressure is applied over the area of the substrate 13.

The front surface of the substrate 13 is provided with a first clinging element having a plurality of randomly disposed, closely adjacent, loops of resilient monofilament line or yarn 26 (as seen in FIG. 3) which extend outwardly from and are secured to the substrate 13.

The other or removable fastening member 12 includes a backing material or substrate 21 which is also a thin flexible length of material which has parallel edges 22 and 23 and rounded ends 24 and 25, the length of the substrate 21 being less than the length of the substrate 13. The inner surface of the substrate 21 is smooth and non-tacky throughout its length. The outer surface of the substrate 21 is provided with a second clinging element having a plurality of small resilient hooks 27 over its entire outer surface area, the hooks 27 being arranged in transverse and longitudinally extending rows. Each hook 27 is a flexible outwardly protruding member, the distal end portion of which is generally semi-circular in shape and the proximal end portion of which is upright and fixed to substrate 21. The hooks 27 appear in alternately opposite facing longitudinal rows extending outwardly and then, in the first row, loop back toward end 24, while the hooks 27 in the next adjacent or second longitudinal row extend outwardly and then loop back toward the opposite end 25. Thus, the hooks 27 in the transverse rows are staggered so that each successive row of hooks 27 extends in a direction opposite to the direction in which its preceding row of hooks 27 extends.

When the fastening members 11 and 12 are brought together and are urged into contact with each other, the hooks 27 of element 12 engage and hold the loops of yarn 26 of the opposing element 11 but are yieldable and therefore, when the two substrates 13 and 21 are pulled away from each other the hooks 27 will release the loop or loops of yarn 26, thereby permitting ready removal of one substrate from the other.

Portions of the ends 24 and 25 of the substrate 21, are respectively provided pin assemblies 30. Each pin assembly 30 includes a flat disc-shaped base 31 on the hook side of substrate 21 and a centrally located pin 32 which protrudes from base 31 through the end portion of substrate 21 and extends perpendicularly outwardly from the backside thereof, terminating in a pointed end 33. An annular locking plate 34 is inserted over each of the pins 31 and is urged down against the back surface of the substrate 21 so as to frictionally engage the shank of the pin 32 and thereby secure the pin 32 in place on the end portion of the substrate 21.

A locking cap 40, having base 41 with a central hole 44 therein, is adapted to be inserted over the end 33 and down onto the shank of pin 32. This cap 40 includes a pair of flexible finger tabs 42 which are spaced in an opposed relationship to each other on base 41 and on opposite sides of hole 44. Each tab 42 is biased inwardly so that an edge of each tab 42 engages a side of the pin 32 and so that, when the tabs 42 are released, they will lock the cap 40 in place on the pin 32. When the two tabs 42 are squeezed or urged together, the edge portions of these tabs 42 will be moved away from the sides of the pin 32 and thereby permit the cap 40 to be readily removed off of the pin 32. A shroud 43, extending diametrically in an arc over base 40 protects end 33 of pin 32 and provides a grip position by which the cap 40 is grasped.

In use, the device of the present invention can be readily installed on opposed portions of apparel.

The base member 11 is installed on the garment such as a belt as explained herein. The removable member 12 is installed on the appropriate opposing waist portion 50 of a garment such as a skirt or pair of pants, so as to register with base member 11. In installing member 12 the pins 32 (caps 40 removed) are passed through appropriately spaced portions of the waist portion 50 and the caps 40 are installed on the inwardly protruding portions of the pins 32. The substrate 21 is thus arranged on the waist portion 50 so that, when the two members 11 and 12 are in registry with each other and forced together they will cling to each other, the belt 20 being positioned appropriately to pass around the waist portion 50. Thus, the two fastening members 11 and 12 will securely hold the waist portion 50 and the belt 20 in overlapping relationship until the belt 20 is forceably withdrawn from the part of the waist 50 which carries the member 12.

In like manner, other overlapping portions of apparel can be removably secured together, such as a skirt and a blouse (not shown), the member 11 being installed on the inner surface of the waist portion of a skirt and the member 12 being installed on the outer shirttail portion of a blouse, or vice versa.

Fastening member 12 is readily transferred from one article of clothing to the next by simply disengaging the pins 32 from one article and reinserting the pins in the next article in the same manner as previously described.

It will be obvious to those skilled that many variations may be made in the embodiment here chosen for the purpose of illustrating the present invention, without departing from the scope thereof as defined by the appended claims.

What is claimed is:

1. A fastening device assembly comprising:

(a) a belt and a garment for covering the lower portion of a human body which are normally arranged in an overlapping relationship and which, with movement of the wearer's body, will be moved with respect to each other;

(b) a first fastening member including a flexible first substrate having opposed surfaces, adhesive disposed along one surface of said first substrate for adhering said first substrate to a surface of either said belt or said garment and a first clinging element secured to the other surface of said first substrate;

(c) a second fastening member including a second flexible substrate having opposite surfaces and a second clinging element secured to one surface of said second substrate;

(d) mounting means connecting said second substrate to the other of said belt or said garment in a position to be adjacent to said first fastening member when said belt and garment are in their overlapping relationship and said first clinging means and said second clinging means are in their overlapping relationship and said first clinging means and said second clinging means are in interlocking relationship; said first clinging means and said second clinging means being sufficiently yieldable that when said belt and said garment are withdrawn from each other said first fastening member and said second fastening member will be released from each other, and wherein said mounting means includes a pair of spaced pins protruding from said second substrate and passing through said other of said belt or garment; and cap means removably received on end portions of said pins for arresting outward movement of said pins back through the other of said belt or garment.

2. The fastening device assembly defined in claim 1 wherein said first substrate is longer than said second substrate.

3. The fastening device assembly defined in claim 1 wherein said first clinging element and said second clinging element include a plurality of loops of yarn for one clinging element and a plurality of resilient hooks for the other clinging element for releaseably engaging said loops of yarn.

* * * * *